US008327650B2

(12) United States Patent
Clayton et al.

(10) Patent No.: US 8,327,650 B2
(45) Date of Patent: Dec. 11, 2012

(54) METHOD AND APPARATUS FOR CONTROLLING THE COOLING POWER OF A CRYOGENIC REFRIGERATOR DELIVERED TO A CRYOGEN VESSEL

(75) Inventors: Nicholas John Clayton, Oxford (GB); Neil Charles Tigwell, Witney (GB); Stephen Paul Trowell, Finstock (GB)

(73) Assignee: Siemens Plc, Frimley, Camberley, Surrey (GB)

( * ) Notice: Subject to any disclaimer, the term of this patent is extended or adjusted under 35 U.S.C. 154(b) by 990 days.

(21) Appl. No.: 12/360,487

(22) Filed: Jan. 27, 2009

(65) Prior Publication Data

US 2009/0193816 A1 Aug. 6, 2009

(30) Foreign Application Priority Data

Jan. 31, 2008 (GB) ..... 0801758.4

(51) Int. Cl.
*F15B 9/00* (2006.01)

(52) U.S. Cl. ..... 62/6; 62/51.1

(58) Field of Classification Search ..... 62/6, 47.1, 62/51.1; 335/301
See application file for complete search history.

(56) References Cited

U.S. PATENT DOCUMENTS 6,828,889 B1 * 12/2004 Zaput ..... 335/216
2006/0022779 A1 * 2/2006 Jiang et al. ..... 335/216

FOREIGN PATENT DOCUMENTS

GB 2 414 538 A 11/2005
GB 2 431 462 A 4/2007

OTHER PUBLICATIONS

Great Britain Search Report dated Mar. 27, 2008 (Two (2) pages).

* cited by examiner

*Primary Examiner* — Marc Norman
(74) *Attorney, Agent, or Firm* — Crowell & Moring LLP

(57) ABSTRACT

The present invention provides a cryostat comprising a cryogen vessel (1), a thermal radiation shield (2), and a sleeve (5) for accommodating a cryogenic refrigerator. Also provided is a first thermal contact for thermally and mechanically connecting a first stage of a cryogenic refrigerator to the radiation shield for cooling thereof. A secondary recondensing chamber is provided (8) for accommodating a second stage of a cryogenic refrigerator, and means (10; 24) are provided for thermally connecting the secondary recondensing chamber to a recondensing surface (11*a*; 44) exposed to the interior of the cryogen vessel. The cryostat further comprises a pressure control arrangement (100) for controlling the pressure of a gas within the secondary recondensing chamber.

22 Claims, 7 Drawing Sheets

METHOD AND APPARATUS FOR CONTROLLING THE COOLING POWER OF A CRYOGENIC REFRIGERATOR DELIVERED TO A CRYOGEN VESSEL

MRI (magnetic resonance imaging) systems are used for medical diagnosis. A requirement of an MRI magnet is that it provides a stable, homogeneous, magnetic field. In order to achieve stability it is common to use a superconducting magnet system which operates at very low temperature, the temperature being maintained by cooling the superconductor, typically by immersion in a cryogenic fluid, such as liquid helium, liquid neon, liquid hydrogen or liquid nitrogen.

FIG. 1 shows a schematic cross-section of a known MRI magnet system fitted with a refrigerator 4, as discussed in UK patent GB2414538. In the illustrated embodiment, a cylindrical cryostat comprises a cryogen vessel 1, containing a cylindrical superconductor magnet (not shown) and liquefied cryogen 16, and is surrounded by one or more thermal shields 2, which are in turn completely surrounded by a vacuum jacket 3. Removably fitted to the magnet system is refrigerator 4 thermally interfaced to a cryogen recondensing chamber 11 by interface sleeve 5 so as to cool the thermal shields and recondense cryogen gas and deliver liquid cryogen back to the cryogen vessel 1 by tube 6.

FIG. 2 shows a thermal interface in such an arrangement in more detail. The bottom of the interface sleeve 5 is terminated in a leak tight manner with thermally conducting base 10 which seals the sleeve and isolates it from the cryogen fluid and gas in cryogen vessel 1. Base 10 accordingly forms part of the wall of the cryogen vessel 1 as well as forming part of the wall of sleeve 5. Base 10 is also part of the wall of recondensing chamber 11. Recondensing chamber 11 encloses a recondenser 11*a* in thermal contact with base 10, and is in communication with cryogen vessel 1 through gas cryogen inlet/liquid cryogen outlet tube 6. A two-stage refrigerator 4 is placed within refrigerator interface sleeve 5. First stage heat exchanger 12*a* of the refrigerator 4 is in thermal contact with shield 2. This contact may be either direct as shown or by known intermediaries such as flexible copper braid. The second stage 7 of the refrigerator 4 is situated in the lower part 8 of refrigerator interface sleeve 5. Second stage 7 terminates in cooling stage 9 which is cooled by the refrigerator to a low temperature, for example about 4K.

Sleeve 5 is filled with a cryogen gas. Cooling stage 9 does not make mechanical contact with base 10. Cooling stage 9 operates to cool the cryogen gas to its liquefaction temperature. Cooling stage 9 is preferably finned to improve recondensation heat transfer. The lower part 8 of sleeve 5 is arranged as a secondary recondensing chamber.

Cooling stage 9 liquefies the gas within the sleeve 5 and more particularly within the secondary recondensing chamber 8. The resultant liquid cryogen 12 accordingly partly fills the bottom of sleeve 5 and provides a heat transfer medium for transferring heat from gaseous cryogen in recondensing chamber 11, via recondenser 11*a* and base 10 to secondary recondenser 9, by boiling at base 10 and recondensation at cooling stage 9.

Base 10 is preferably made from highly thermally conducting material, typically copper, and provides good thermal conduction from its upper surface 10*a* in contact with liquid 12 to its lower surface and on to recondenser 11*a*. The upper surface of cryogen liquid 12 should preferably not touch the cooling stage 9 since this would reduce the surface area available for recondensation, and therefore would also reduce the rate of heat transfer. Liquid cryogen 12 and its gaseous counterpart provide a non-contact ('recondenser') thermal interface between cooling stage 9 and base 10.

First stage heat exchanger 12*a* between the refrigerator and the sleeve is provided with at least one gas path 13 so that gas can pass between the upper and lower parts of the interface sleeve 5 for evacuation of the sleeve, refilling with cryogen gas, and release of cryogen gas, as and when appropriate.

During cooling of the magnet system and the refrigerator to operating temperature, or when the magnet system and refrigerator have been cooled to operating temperature, further cryogen gas may be slowly admitted through port 14 into the interface sleeve 5. The gas is admitted slowly so that the refrigerator 4 can cool and liquefy it as appropriate. The quantity of gas admitted is measured so that the appropriate quantity of liquid 12 is condensed in the secondary recondensing chamber 8.

When the refrigerator is turned off for servicing, or if the refrigerator should be turned off or stopped unintentionally, the liquid cryogen 12 will boil and evaporate. A pressure relief valve 15 is fitted to the interface sleeve 5 to prevent excessive pressure developing in the sleeve under these circumstances.

The interface provides thermal connection between refrigerator 4 and recondenser 11*a*. While any suitable gas 12 may be used in the secondary recondensing chamber 8, the boiling point of the gas 12 in the secondary recondensing chamber 8 should be no greater than the boiling point of the gas in the recondensing chamber 11. The same gas may be used in both recondensing chambers. If gases with differing boiling points are used, a thermal resistance may be placed in the thermal path 10 to improve the efficiency of the recondenser 11*a*. The recondensation of gas within chamber 11 will only occur if the boiling point of liquid cryogen 12 in the secondary recondensing chamber 8 is lower than the boiling point of the cryogen in recondensing chamber 11. If the same cryogen is used in both recondensing chambers, this is arranged by ensuring that the pressure of gaseous cryogen in secondary recondensing chamber 8 is lower than the pressure of gaseous cryogen in recondensing chamber 11.

FIG. 3 shows another arrangement employing a dual recondensing thermal interface. This arrangement is described in US patent application 2006207265 and UK patent GB2431462.

In this arrangement, the recondensing chamber 11 of FIG. 2 is replaced by a heat path 24 to a recondensing surface 44 within a service neck 22 exposed to the interior of cryogen vessel 1. Refrigerator sleeve 5 is isolated from the main cryogen vessel 1. The sleeve 5 is filled with a cryogen such as helium. The refrigerator 4 is provided with a first stage heat exchanger 32 which acts through thermal link 40 to cool thermal shield 2. The refrigerator 4 is also provided with a second cold stage heat exchanger 9 exposed to the cryogen in the sleeve. In operation, the gaseous cryogen in the sleeve recondenses on the heat exchanger 9 into its liquid state. The liquid cryogen drips on to the heat path 24 in region 34. The heat path 24 is cooled to the temperature of the liquid cryogen. Heat is drawn away from the service neck 22, cooling the recondensing surface 44 exposed inside the service neck to the temperature of the liquid cryogen in secondary recondensing chamber 8. This causes condensation of boiled off cryogen from the cryogen vessel 1 on the recondensing surface 44 inside the service neck 22. This condensation releases latent heat to the thermal path 24. This heat travels along the thermal path 24 and results in the boiling of the liquid cryogen in the secondary recondensing chamber 8. The region 34 of the heat path 24 may be finned or otherwise machined or prepared so as to increase the surface area for heat transfer, yet still allowing the free flow of liquid across the surface. The refrigerator 4 cools this boiled-off cryogen in turn, resulting in an efficient removal of heat from the boiled off cryogen in the cryogen vessel 1. As the boiled off cryogen in the service neck condenses to liquid, the pressure of the boiled off cryogen in this volume reduces, drawing further cryogen vapour into the service neck 22, to be recondensed.

The interface is arranged such that the cryogen in sleeve 5 has a lower boiling point than the cryogen in the vessel 10. This is in order that the thermal path 24, cooled to the boiling point of the cryogen in the sleeve 5, is cold enough to cause recondensation on the surface 44. This may be achieved by maintaining a lower gas pressure in the sleeve 5 than the gas pressure in the cryogen vessel 1.

In conventional operation, the pressure of cryogen gas within the cryogen vessel 1 is maintained above atmospheric pressure. This is intended to prevent, or at least reduce the tendency for, contamination to enter the cryogen vessel 1. At the temperature of the cryogen vessel, air will freeze and any air entering the cryogen vessel will form a troublesome ice deposit. It is also conventional to operate the refrigerator 4 at full power. One reason for this is to ensure that the thermal shield 2 is kept cool, reducing thermal influx to the cryogen vessel 1. However, by keeping the refrigerator 4 running at full power, the cooling at the second stage 9 may be found so effective at recondensing gaseous cryogen in the cryogen vessel 1 that the pressure of gaseous cryogen within the cryogen vessel may drop below the desired pressure, and indeed may drop below atmospheric pressure. This is of course undesirable, since a pressure less than atmospheric—which may be described as a negative gauge pressure—within the cryogen vessel will increase the tendency of air to enter the cryogen vessel and form troublesome ice deposits. During certain operations, for example during imaging procedures, heat is generated within the cryogen vessel 1, and this heat needs to be removed by operating the refrigerator 4 at full power. At other times, for example when the MRI system is in a standby state, it would be sufficient to operate the refrigerator 4 at reduced power, which would have the benefit of maintaining the pressure in the cryogen vessel 1 greater than atmospheric pressure—which may be described as a positive gauge pressure.

This problem arises in cryostats which have secondary recondensing chambers as described above, and in other arrangements in which a recondensing surface, typically the second stage heat exchanger of the refrigerator, is exposed to the interior of the cryogen vessel; it also applies to other arrangements in which the cold heat exchanger of the refrigerator is thermally linked to a recondensing surface in the cryogen vessel through a solid thermally conductive link.

One could attempt to address this problem by varying the cooling power delivered by the refrigerator itself. However, such arrangements will reduce the cooling power available for cooling the thermal radiation shield 2. This is undesirable at least for the reason that the thermal radiation shield has a relatively long thermal time-constant for re-cooling the shield, should it warm up due to an interruption or reduction in cooling power.

It would be advantageous, in addressing the above-mentioned problem, to de-couple the first and second refrigeration stages of the refrigerator, so that the first stage may be continuously operating at full power to cool the thermal radiation shields, while the second refrigeration stage may be enabled and disabled according to the need for cooling of the cryogen gas in the cryogen vessel. However, conventional cryogenic refrigerators are not arranged to provide de-coupling of the second stage.

The present invention allows effective decoupling of the second stage of the refrigerator, by allowing control of the effectiveness of the thermal interface between the second cooling stage 9 and the cryogen vessel 1, allowing the refrigerator 4 to be operated at full power at all times, to provide effective cooling of the thermal radiation shield 2, yet avoiding the possibility of over-cooling the cryogen vessel 1 such that the pressure of gaseous cryogen in the cryogen vessel does not fall below a desired level.

The present invention provides methods and apparatus for controlling cooling of a cryogen vessel 1 and a thermal shield 2 of the cryogen vessel 1, which enables the thermal shield 2 to be cooled at full power, yet allows the cooling applied to gaseous cryogen in the cryogen vessel 1 to be controlled. An advantage of this is that the thermal radiation shield 2 may be effectively cooled, limiting thermal influx to the cryogen vessel 1, while avoiding the problem of over-cooling the gaseous cryogen in the cryogen vessel 1, which would otherwise result in undesirably low pressure within the cryogen vessel 1.

Accordingly, the present invention provides apparatus and methods as defined in the appended claims.

The above, and further, objects, advantages and characteristics of the present invention will be more apparent from consideration of the following description of certain embodiments thereof, given by way of examples only, in conjunction with the accompanying drawings, wherein.

According to the present invention, a method is provided for varying the thermal coupling between the cold stage of the refrigerator typically a second cooling stage, by controlled thermal conductivity, while maintaining full thermal coupling of an intermediate stage, typically a first cooling stage.

Figure 1:
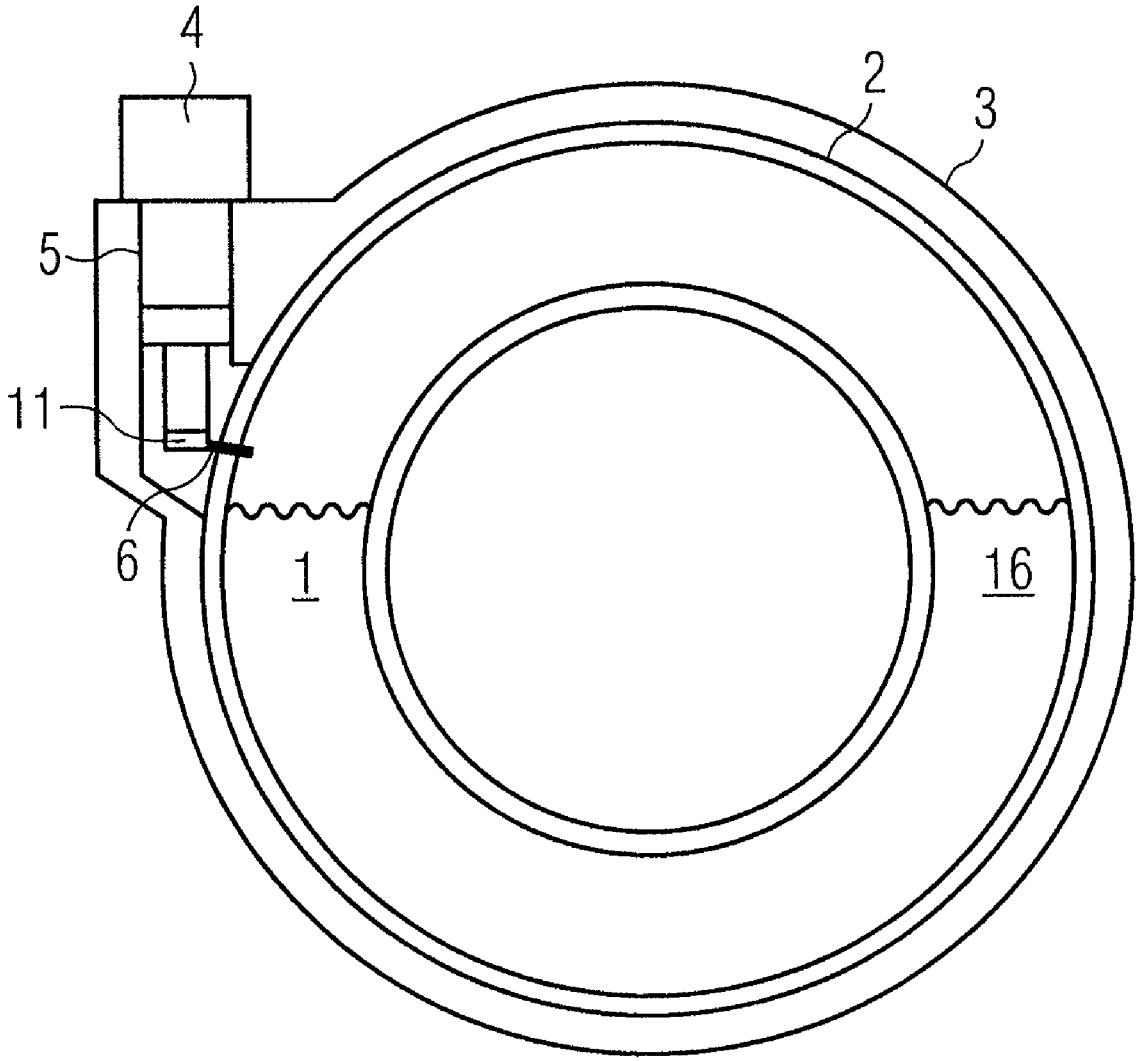
FIG. 1 shows a schematic cross-section of a known MRI magnet system.
Figure 2:
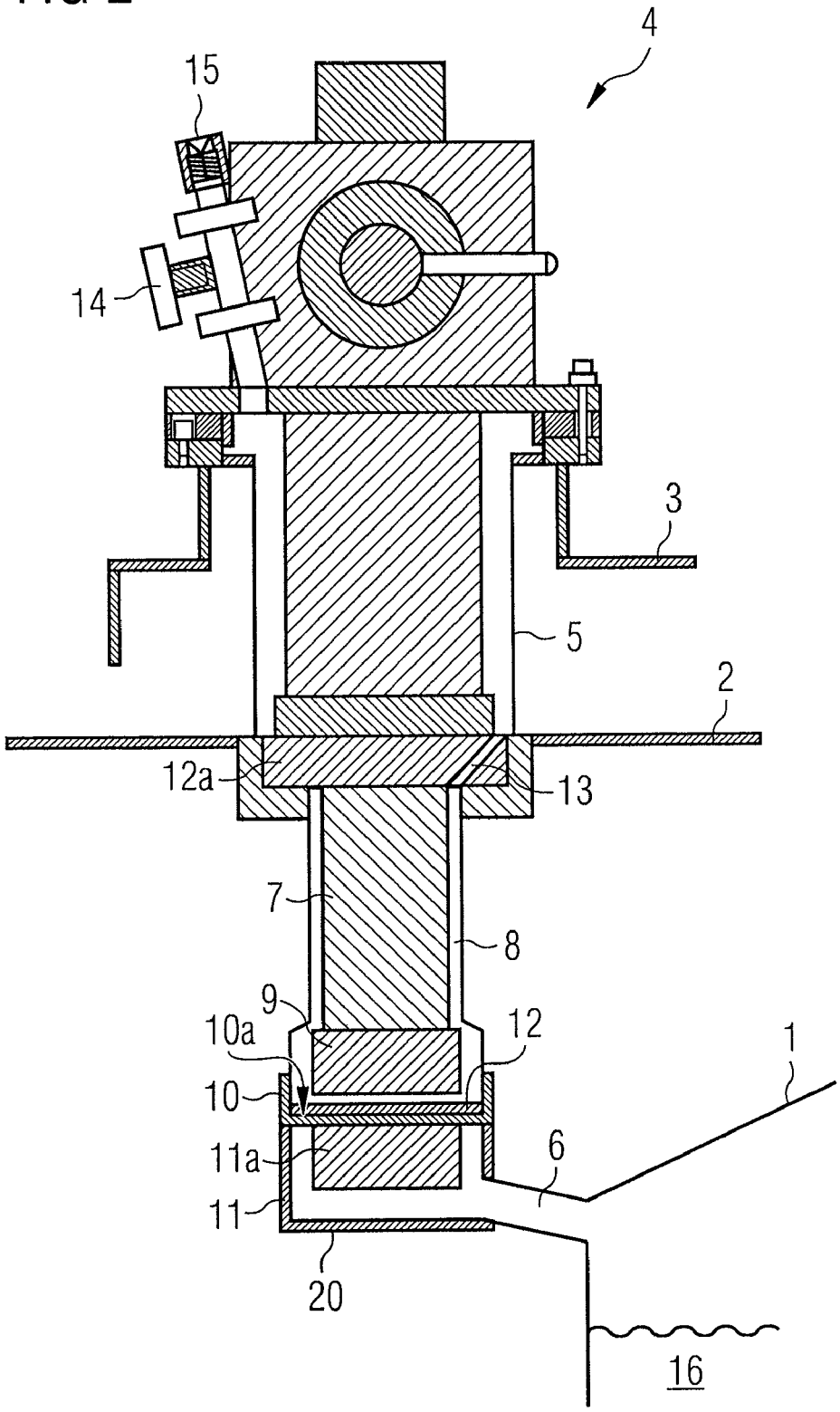
FIG. 2 shows a dual recondensing thermal interface in an arrangement such as shown in FIG. 1.
Figure 3:
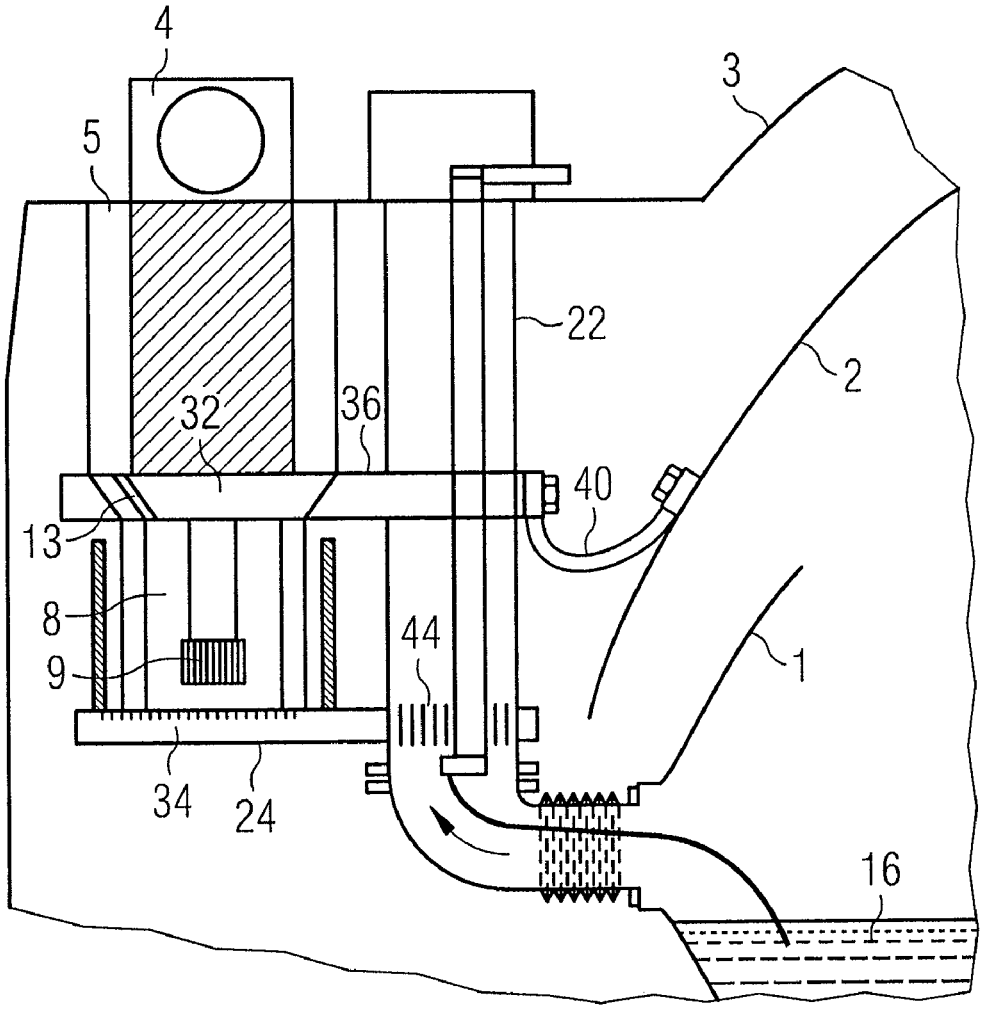
FIG. 3 shows another arrangement employing a dual recondensing thermal interface.

In a preferred embodiment, a dual recondensing arrangement is employed, such as illustrated in FIG. 2 or FIG. 3. However, according to the present invention, an arrangement is provided for varying the pressure of gaseous cryogen within the secondary recondensing chamber 8, which is exposed to the recondensing surface 9 of the refrigerator 4. As has been discussed above, the dual recondensing arrangement is only effective to recondense gaseous cryogen in the cryogen vessel 1 if the boiling point of liquid cryogen in the secondary recondensing chamber 8 is lower than the boiling point of cryogen in the cryogen vessel 1. In instances where the same cryogen is used in the secondary recondensing chamber 8 and the cryogen vessel 1, the pressure of gaseous cryogen must be lower in the secondary recondensing chamber 8 than in the cryogen vessel 1 to ensure the lower boiling point.

According to an aspect of the present invention, the pressure in the secondary recondensing chamber 8 is varied according to detected pressure within the cryogen vessel 1, or in accordance with operation of the MRI system, so that effective thermal connection is provided between the refrigerator 4 and the cryogen vessel 1 when effective cooling of the cryogen vessel is required, but a less effective thermal connection is provided between the refrigerator 4 and the cryogen vessel 1 when less effective cooling of the cryogen vessel is required. This allows the refrigerator 4 to operate at full power, ensuring effective cooling of the thermal radiation shields 2, but avoids the problem of low pressure, possibly negative gauge pressure, in the cryogen vessel 1.

The present invention may be carried out with the same or different cryogens in the secondary recondensing chamber 8 and the cryogen vessel 1. In some embodiments, the cryogen in the secondary recondensing chamber 8 may not in fact recondense, but may simply be cooled to a certain temperature by the refrigerator 4. This will work provided that the recondensing surface 11*a* or 44 is cold enough to liquefy the gas in the cryogen vessel 1. The recondensing surface 11*a* or 44 must be cooled to a temperature colder than the boiling point of the gas in the cryogen vessel 1, which is itself a function of the pressure of the gas in the cryogen vessel 1. For example, a gaseous helium cryogen may be provided in the secondary recondensing chamber 8, while the cryogen vessel 1 contains a nitrogen cryogen. The helium may be cooled to a temperature of around 76K by a suitable refrigerator, while the pressure of helium within the secondary recondensing chamber 8 may be varied to vary the thermal conductivity between the refrigerator 4 and the cryogen vessel 1. In such an arrangement, care should be taken not to over-cool the recondensing surface in the cryogen vessel 1, since this may lead to deposits of solid cryogen.

According to an aspect of the present invention, by controlling the pressure in the secondary recondensing chamber 8, the cooling power delivered into the cryogen vessel 1 by the refrigerator 4 may be controlled. In such a manner, the pressure within the cryogen vessel 1 may be controlled. Variation in gas pressure within secondary recondensing chamber 8 will have no appreciable effect on thermal coupling between the first cooling stage and the thermal radiation shields, which are thermally coupled by a mechanical link.

By controlling the pressure of cryogen gas in the secondary recondensing chamber 8, the thermal conductivity between the second stage 9 of the refrigerator 4 and the cryogen vessel 1 may be varied, through a range from a maximum of cooling power to zero cooling power. Without wishing to be bound by any particular theory, the inventors believe that this operation results from changes in thermal conductivity of gas in the secondary recondensing chamber 8 as the pressure is controlled. The density of helium gas at temperatures <5K changes rapidly with pressure (~7%/psi (~1%/kPa) at 15 psi (103466 Pa) absolute) leading to a change in thermal conductivity of order 2.5%/psi (~0.3%/kPa) at 15 psi (103466 Pa) absolute. Zero cooling power will be delivered when the secondary recondensing chamber is evacuated. Maximum cooling power will be delivered when the gaseous cryogen in the secondary recondensing chamber is at a highest possible pressure at which the boiling point of liquid cryogen in the secondary recondensing chamber 8 is sufficiently lower than the boiling point of cryogen in the cryogen vessel 1 to provide effective recondensation.

By varying the pressure of cryogen gas in the secondary recondensing chamber 8, the thermal conductivity of the gas is varied. This change in thermal conductivity affects the amount of cooling power which reaches the recondensing surface exposed to the cryogen vessel 1 from second refrigerator stage 9.

With low, or zero, cooling power reaching the cryogen vessel 1, the natural thermal influx and resulting boil-off of liquid cryogen within the cryogen vessel 1 will ensure that the pressure of gaseous cryogen within the cryogen vessel 1 remains above atmospheric pressure.

Figure 4:
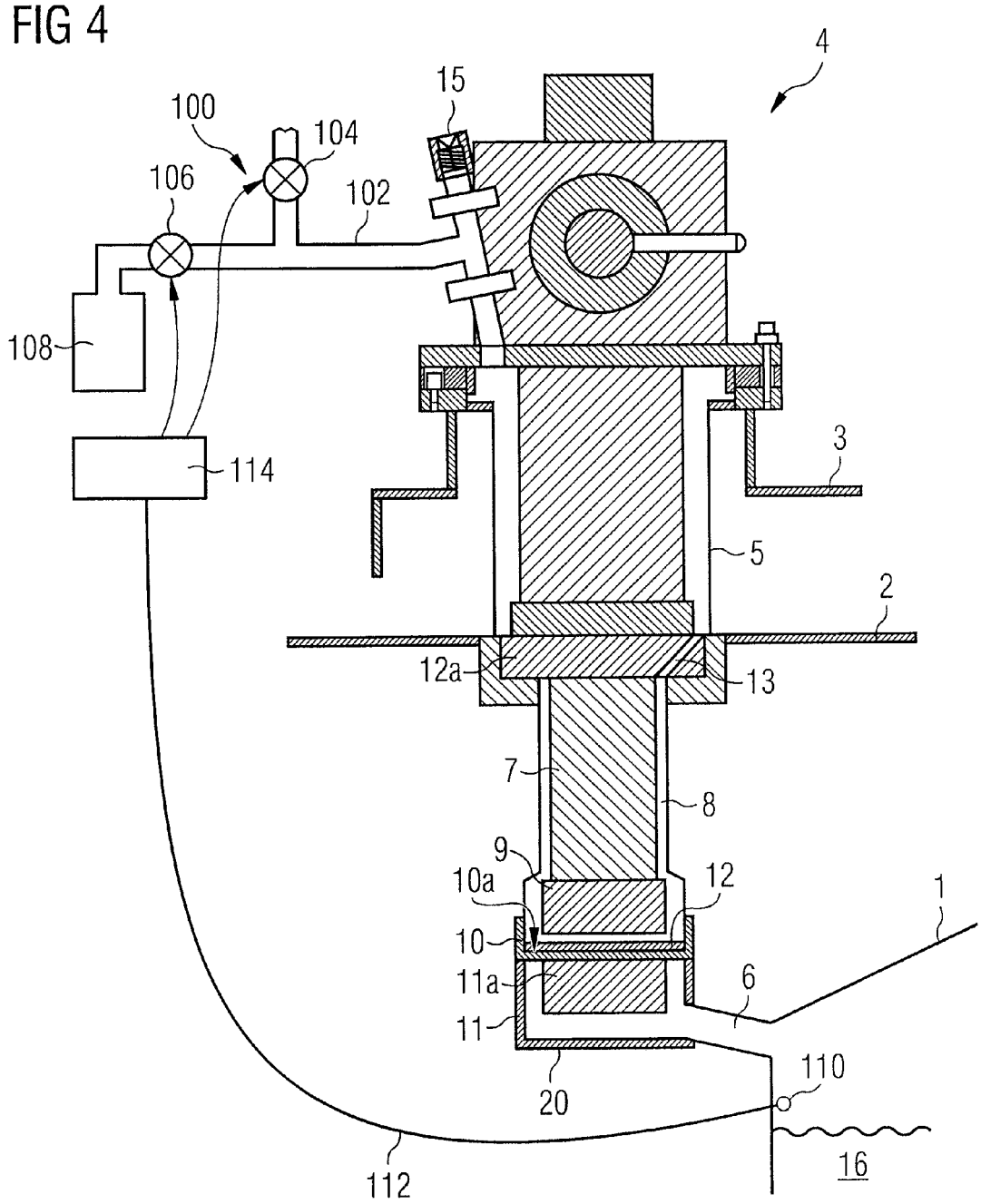
FIGS. 4 and 5 show embodiments of the present invention, as applied to the arrangements shown in FIGS. 2 and 3.
Figure 5:
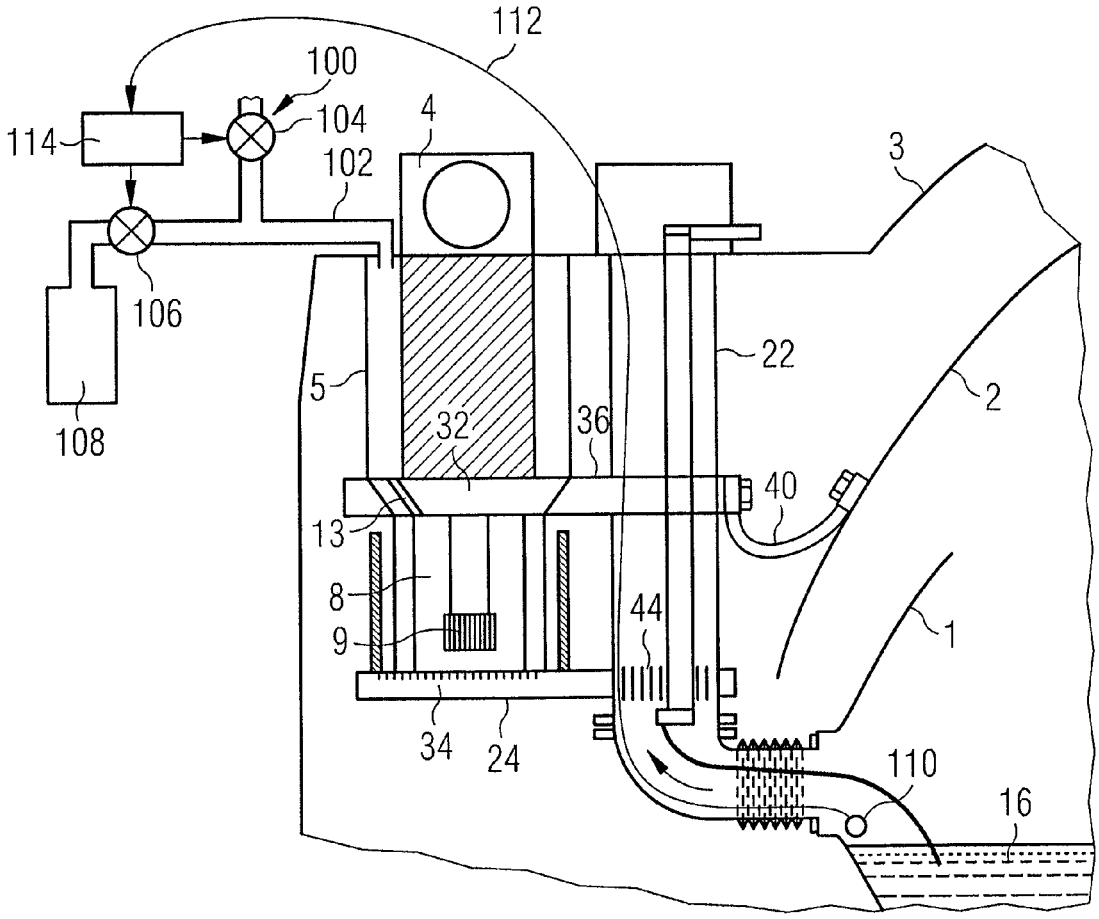

FIGS. 4 and 5 show embodiments of the present invention, as applied to the arrangements shown in FIGS. 2 and 3 and described above.

In each of FIGS. 4 and 5, the secondary recondensing chamber 8 is in communication with the remainder of the refrigerator sleeve 5 through a gas channel 13 formed at the first cooling stage heat exchanger. A gas inlet/outlet arrangement 100 is provided, to introduce and remove cryogen gas into and from the refrigerator sleeve 5 through a tube 102 which accesses the inside of the refrigerator sleeve 5. Tube 102 is connected to two separate controlled valves 104, 106. In a preferred embodiment, these are solenoid controlled valves, but other types of controlled valves may be employed as appropriate. The first controlled valve 104 leads to a venting arrangement, which may include recuperation of discharged cryogen gas, or may be a simple vent to atmosphere. The second controlled valve 106 is connected to an external source of cryogen gas 108 at a higher pressure than required in the sleeve 5. A sensor 110 is provided within the cryogen vessel 1, to measure the pressure or temperature of cryogen gas within the cryogen vessel 1. The sensor is connected 112 to a controller 114. The controller 114 may be a dedicated controller provided for the purpose, or may be a feature of a larger system controller. Connections 112 between the controller 114 and the sensor 110 may be by wires, led into the cryogen vessel through a suitable access turret. Alternatively, a wire-less communication arrangement may be provided, provided that care is taken to avoid interference with associated systems.

In operation, the sensor 110 sends a signal to the controller 114 indicating the temperature or pressure of gas in the cryogen vessel 1. If the sensor indicates a pressure below a required minimum value, the controller 114 may respond by briefly opening vent valve 104. This will reduce the pressure of gas within the sleeve 5, and so also within the secondary recondensing chamber 8. As a result, the thermal conductivity of the gaseous cryogen within the secondary recondensing chamber 8 will reduce. This will result in reduced cooling power at recondensing surface 11*a*, 44 exposed to the cryogen vessel 1, which in turn will allow the cryogen gas within the cryogen vessel 1 to warm by parasitic heat influx, or by heat generated within the cryogen vessel itself. This will cause the temperature and pressure of cryogen gas in the cryogen vessel 1 to rise. This will be detected by the sensor 110. The controller 114 may respond by briefly opening vent valve 104 again, if further increase in the pressure of gaseous cryogen in the cryogen vessel 1 is required. Alternatively, the controller may determine that the changes made to gas pressure within the secondary recondensing chamber 8 are sufficient, and no further change is required.

On the other hand, the sensor 110 may send a signal to the controller 114 indicating a pressure above a required maximum value. In this case, the controller 114 may respond by briefly opening inlet valve 106. This will increase the pressure of gas within the sleeve 5, and so also within the secondary recondensing chamber 8. As a result, the thermal conductivity of cryogen gas within the secondary recondensing chamber 8 will rise. This will result in increased cooling power at the recondensing surface 11*a*, 44 exposed to the cryogen vessel 1, possibly resulting in recondensation of cryogen gas into liquid. This will cause the temperature and pressure of cryogen gas in the cryogen vessel 1 to fall. This will be detected by the sensor 110. The controller 114 may respond by briefly opening inlet valve 106 again, if further increase in the pressure of gaseous cryogen in the cryogen vessel is required. Alternatively, the controller may determine that the changes made to gas pressure within the secondary recondensing chamber are sufficient, and no further change is required.

In further embodiments, control of the inlet and vent valves 106, 104 may instead, or additionally, be based on the operation of an associated MRI system or similar; in particular, the operation of an equipment located within the cryogen vessel 1. For example, the controller 114 may be connected to detect the commencement of an MRI imaging cycle. During such a cycle, it is normal for an amount of heat to be generated within the cryogen vessel, for example by operation of gradient coils. In response to the detection of commencement of an MRI imaging cycle, the arrangement of the present invention may increase the pressure of cryogen gas within the secondary recondensing chamber 8, so increasing the thermal conductivity of secondary recondensing chamber 8, and causing increased cooling to the cryogen gas within the cryogen vessel 1 for the duration of the imaging cycle. This will ensure that the cryogen gas within the cryogen vessel 1 is adequately cooled during the imaging cycle. Similarly, the controller 114 may be connected to detect an associated MRI imaging system entering a standby mode. While the system is in standby mode, no imaging will be performed. Heat influx to the cryogen vessel 1 will be effectively limited to parasitic heat influx from ambient temperature. In such state, a reduced level of cooling is sufficient to maintain the gaseous cryogen in the cryogen vessel 1 at the required positive gauge pressure. In response to the detection of standby mode, the arrangement of the present invention may reduce the pressure of gas within the secondary recondensing chamber 8, reducing the thermal conductivity of the secondary recondensing chamber 8, and causing reduced cooling to the cryogen gas within the cryogen vessel 1. This will ensure that the cryogen gas within the cryogen vessel 1 is not overcooled, which may otherwise result in a negative gauge pressure, while allowing the refrigerator 4 to be operated at full power to cool the thermal radiation shield 2.

According to an aspect of the present invention, the cooling provided by the second stage of the refrigerator is controlled by the gas pressure inside the secondary recondensing chamber, while the cooling provided by the first stage of the refrigerator, by mechanical contact to the thermal radiation shields, is unaffected by the gas pressure inside the secondary recondensing chamber.

Typical venting systems receive boiled-off cryogen gas at about atmospheric pressure. A vent direct to atmosphere will of course be at atmospheric pressure, and cryogen gas recuperation arrangements typically operate a cryogen gas inlet at about atmospheric pressure. While this may be expected to be a sufficiently low pressure for operation of the present invention in most circumstances, a vacuum pump may be connected to the vent valve 104 to reduce the pressure of cryogen gas within the secondary recondensing chamber 8 to below atmospheric, if required. A very low, sub-atmospheric, pressure of cryogen gas within the secondary recondensing chamber will result in a very low thermal conductivity of the secondary recondensing chamber, resulting in low cooling power delivered to the recondensing surface exposed to the cryogen vessel.

By controlling cooling and recondensation within the cryogen vessel 1, consumption of cryogen may be reduced or eliminated. A very small amount of cryogen may be consumed in varying the pressure within the secondary recondensing chamber 8 by exhaust through vent valve 104, although this may be recovered by a cryogen recuperation arrangement, known in itself.

The external gas source 108 described above may be an external gas bottle at relatively high pressure. In an alternative arrangement, the external gas source 108 may be replaced by a pipe providing cryogen gas from the cryogen vessel 1, since the pressure of gas within the sleeve 5 should be at a pressure no more than the pressure inside the cryogen vessel 1. A degree of self-regulation may usefully be provided by such arrangements providing cryogen gas to the secondary recondensing chamber 8 from the cryogen vessel 1. When the gas pressure within the cryogen vessel is relatively high, the thermal conductivity of the secondary recondensing chamber should be increased by increasing the pressure of gas within the secondary recondensing chamber. On the other hand, when the gas pressure within the cryogen vessel is relatively low, the thermal conductivity of the secondary recondensing chamber should be reduced by reducing the pressure of gas within the secondary recondensing chamber.

Figure 6:
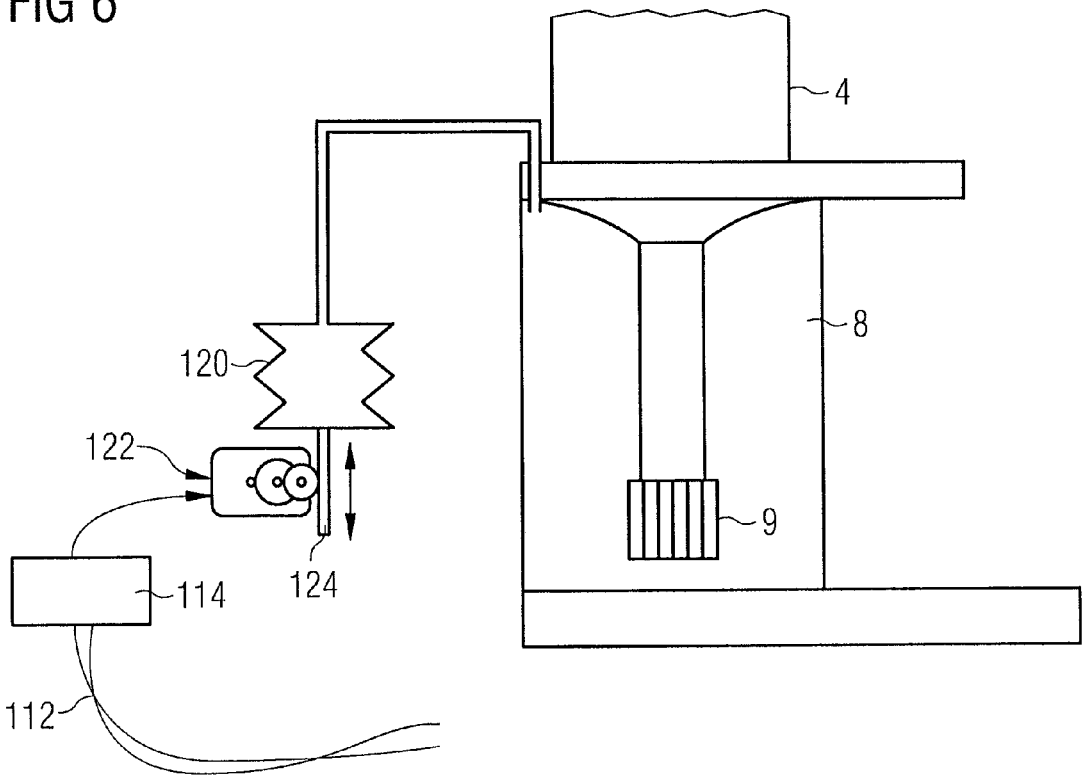
FIG. 6 illustrates another embodiment of the present invention.

FIG. 6 illustrates another alternative arrangement, in which a gas-containing bellows 120, in communication with the secondary recondensing chamber 8, is controlled in volume by operation of a mechanical driver 122. In operation, the controller 114 receives data from sensor 110 as described with reference to FIGS. 4 and 5. Rather than controlling inlet and vent valves to control the pressure within the secondary recondensing chamber, as in the embodiments shown in FIGS. 4 and 5, the controller 114 controls mechanical driver 122 to increase or reduce the volume of the bellows, so reducing or increasing, respectively, the pressure within the secondary recondensing chamber 8.

In the illustrated embodiment, the mechanical driver 122 comprises a stepper motor with gear drive operating linear motion of a shaft 124 which adapts the volume of the attached bellows 120. However, other mechanical drive arrangements could be provided. The bellows may be replaced by a piston arrangement. The linear motion of the shaft may be replaced by a piston rod driven by a rotary crank. The gear drive operating on the shaft may be replaced by a rotary cam acting on a surface of the shaft.

Any of these arrangements may be operated by a stepper motor driven by a signal from the controller 114.

Figure 7:
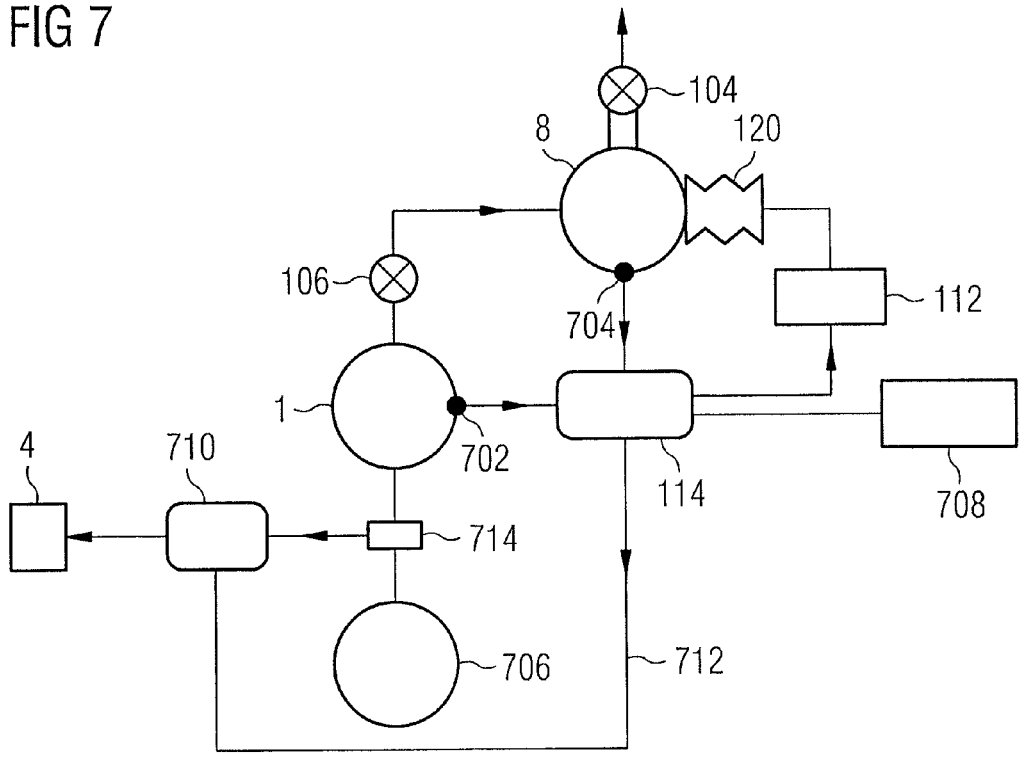
FIG. 7 shows a function map of an arrangement according to the present invention integrated into a conventional MRI system.

FIG. 7 shows a function map of an arrangement according to the present invention integrated into a conventional MRI system. Absolute pressure transducer 702 measures the absolute pressure within the cryogen vessel 1. Absolute pressure transducer 704 measures the absolute pressure within the secondary recondensing chamber 8. These pressure measurements are supplied to the controller 114. Atmospheric pressure is represented at 706. The controller 114 operates the mechanical driver 122 to drive the bellows 120 accordingly. Optionally, the position of the bellows may be reported to a remote logging facility 708 by the controller 114. Pressure switch 714 indicates gauge pressure inside the cryogen vessel 1, that is, the difference between the absolute pressure in the cryogen vessel 1 and atmospheric pressure 706, to the compressor 710, and will signal any significant change to the gauge pressure inside the cryogen vessel. The compressor 710 may be arranged to vary in operating frequency, or gas charge, and so in delivered cooling power, in response to such indication, but such arrangements do not form part of the present invention.

In certain embodiments, provision may be made for varying the frequency of operation, or gas charge, of compressor 710 when available variation of pressure within the secondary recondensation chamber 8 is insufficient for the required range of change in cooling power to the cryogen vessel. For example, the available variation in pressure within the secondary recondensation chamber 8 may be restricted by extremes of displacement of the bellows 120. Assuming a nominal operating frequency of the compressor 710 of 50 Hz, variation of the frequency of operation of the compressor 710 within the range 40 Hz to 60 Hz would allow further variation in the delivered power of the refrigerator 4 as a whole. A signal path 712 between the controller 114 and the compressor 710 allows such control of the compressor operating frequency. Of course, by varying the frequency of operation of the compressor 710, the cooling power delivered to the thermal radiation shield will vary, which is not generally desirable.

A further advantage of arrangements of the present invention allows the sleeve 5 to be evacuated for shipping, and subsequently refilled with cryogen gas upon arrival at site. When not operating, the refrigerator 4 is a major source of heat influx to the system and contributes significantly to the boil-off rate. Re-filling of the sleeve with cryogen gas could be arranged using an external gas source. Preferably, however, an existing refrigerator transit line/valve (14 in FIG. 2) is used in a different function to backfill the sleeve from the cryogen vessel 1. By evacuating the sleeve 5 for shipping, thermal influx to the cryogen vessel is significantly reduced, reducing cryogen boil-off rate and so increasing the length of time that the cryogen vessel remains cooled by liquid cryogen before it boils dry. This increases the length of time allowed for shipping, potentially saving costs by allowing more flexible logistical arrangements.

Figure 8:
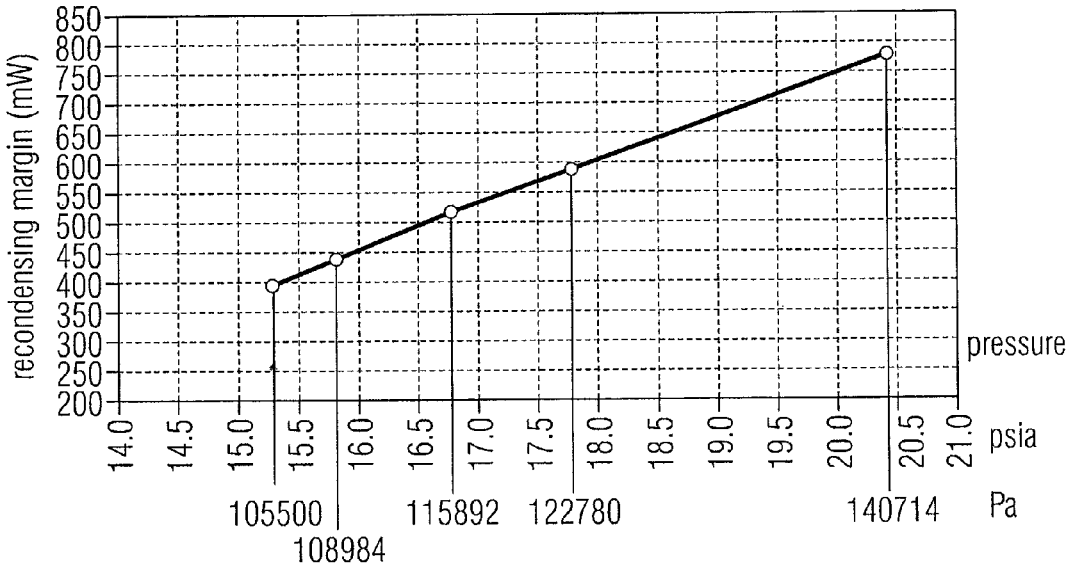
FIG. 8 shows test data from experiments done using an embodiment of the present invention.

FIG. 8 shows test data from experiments done using an embodiment of the present invention where the pressure of a helium cryogen in the sleeve 5 and the secondary recondensing chamber 8 was varied and the recondensing margin was measured, starting from a margin of about 400 mW at 15.3 psi (105500 Pa) absolute.

The term "recondensing margin" may be explained with reference to an example. Assume that total heat influx and heat generated within the cryogen vessel 1 is 500 mW, and that with a high pressure in the secondary recondensing chamber 8, the refrigerator 4 delivers 1200 mW of cooling power into the cryogen vessel 1, then the recondensing margin in this situation is 700 mW: the cooling power delivered in excess of that required to overcome total heat influx and heat generated. In this example, the cryogen within the cryogen vessel will be cooled at a rate of 700 mW.

Now, suppose an intermediate pressure is present in the secondary recondensing chamber 8, the refrigerator 4 may deliver only 800 mW of cooling power into the cryogen vessel 1. The recondensing margin is now 300 mW. The cryogen within the cryogen vessel will be cooled at a rate of 300 mW. Finally, suppose a relatively low pressure is present in the secondary recondensing chamber 8, the refrigerator 4 may deliver only 400 mW of cooling power into the cryogen vessel 1. The recondensing margin is now −100 mW. The cryogen within the cryogen vessel will warm at a rate of 100 mW.

Approximating the curve of FIG. 8 to a linear response, we have a rise in recondensing margin of 80 mW/psi (11.6 mW/kPa) or typically 20% margin change for each 1 psi (6897 Pa) variation. This effect has been attributed to the change in thermal conductivity of the gas as a function of pressure. The density of helium gas at temperatures <5K changes rapidly with pressure (~7%/psi (~1%/kPa) at 15 psi (103466 Pa) absolute) leading to a change in thermal conductivity of order 2.5%/psi (~0.3%/kPa) at 15 psi (103466 Pa) absolute. This is sufficient to result in a measurable difference in recondensing power as a function of pressure. As can be clearly seen from the data in FIG. 8, variation of pressure within the secondary recondensing chamber 8 has a significant and controllable effect on the overall recondensing margin of the refrigerator in the cryogen vessel.

While the present invention has been described with particular reference to MRI imaging systems, it may equally be applied to other cryogenically cooled arrangements variable temperature inserts. These are research cryostats which can cool experiments in the temperature range (4.2 K<T<300 K). Furthermore, although the present invention has been described with particular reference to helium as the cryogen, it may be applied to systems which employ other cryogens, such as hydrogen, neon or nitrogen.

The invention claimed is:

1. A cryostat comprising a cryogen vessel, a thermal radiation shield, a sleeve for accommodating a cryogenic refrigerator; a first thermal contact for thermally and mechanically connecting a first stage of a cryogenic refrigerator to the radiation shield for cooling thereof; a secondary recondensing chamber for accommodating a second stage of a cryogenic refrigerator and means for thermally connecting the secondary recondensing chamber to a recondensing surface exposed to the interior of the cryogen vessel, wherein the cryostat further comprises a pressure control arrangement for controlling the pressure of a gas within the secondary recondensing chamber.

2. A cryostat according to claim 1, wherein the pressure control arrangement is arranged to control the pressure of the gas within the secondary recondensing chamber within a range of pressures, which lie within the range of vacuum to the pressure of a gas within the cryogen vessel.

3. A cryostat according to claim 1, wherein the gas within the secondary recondensing chamber is the same gas as the gas within the cryogen vessel.

4. A cryostat according to claim 1, wherein the pressure control arrangement comprises:

an inlet valve so as to admit gas into the secondary recondensing chamber, thereby increasing the pressure of the gas within the secondary recondensing chamber; and a vent valve so as to release gas from the secondary recondensing chamber, thereby reducing the pressure of the gas within the secondary recondensing chamber.

5. A cryostat according to claim 4, further comprising a controller arranged to control operation of the inlet valve and the vent valve.

6. A cryostat according to claim 5, wherein the controller is arranged to control operation of the inlet valve and the vent valve according to a gas pressure within the cryogen vessel.

7. A cryostat according to claim 5, wherein the controller is arranged to control operation of the inlet valve and the vent valve according to operational status of an equipment located within the cryogen vessel.

8. A cryostat according to claim 4, wherein the inlet valve is connected to receive gas from an external gas supply.

9. A cryostat according to claim 4, wherein the inlet valve is connected to receive gas from the cryogen vessel.

10. A cryostat according to claim 4, wherein the vent valve is connected to a vacuum pump, to evacuate the secondary recondensing chamber.

11. A cryostat according to claim 1, wherein the pressure control arrangement comprises:

a bellows in communication with the secondary recondensing chamber, said bellows being controllable in volume so as to admit gas into the secondary recondensing chamber, thereby increasing the pressure of the gas within the secondary recondensing chamber; and so as to release gas from the secondary recondensing chamber, thereby reducing the pressure of the gas within the secondary recondensing chamber.

12. A cryostat according to claim 11, further comprising a controller arranged to control operation of the bellows.

13. In combination, a cryostat according to claim 1, and a cryogenic refrigerator accommodated within the sleeve, the cryogenic refrigerator having a first stage operative to cool to a first cryogenic temperature and in thermal and mechanical contact with the thermal radiation shield, and a second cooling stage operative to cool to a second cryogenic temperature, lower than the first cryogenic temperature, operative to cool gas within the secondary recondensing chamber.

14. A combination according to claim 13, wherein thermal conductivity between the second cooling stage and the recondensing surface exposed to the interior of the cryogen vessel is provided through the gas within the secondary recondensing chamber.

15. A method for controlling the cooling power of a cryogenic refrigerator delivered to a cryogen vessel, while operating the refrigerator at full power comprising the step of, in a cryostat comprising a cryogen vessel; a sleeve accommodating the cryogenic refrigerator; wherein a first thermal contact thermally and mechanically connects a first stage of the cryogenic refrigerator to the radiation shield for cooling thereof; a secondary recondensing chamber accommodates a second stage of a cryogenic refrigerator; and the secondary recondensing chamber is thermally connected to a recondensing surface exposed to the interior of the cryogen vessel, controlling the pressure of a gas within the secondary recondensing chamber.

16. A method according to claim 15, wherein the pressure of the gas within the secondary recondensing chamber is controlled within a range of pressures, which lie within the range of vacuum to a pressure of a gas within the cryogen vessel.

17. A method according to claim 15, wherein the gas within the secondary recondensing chamber is the same gas as the gas within the cryogen vessel.

18. A method according to claim 15, wherein the pressure control method comprises:

controlling a volume of a bellows in communication with the secondary recondensing chamber, so as to admit gas into the secondary recondensing chamber, thereby increasing the pressure of the gas within the secondary recondensing chamber; and so as to release gas from the secondary recondensing chamber, thereby reducing the pressure of the gas within the secondary recondensing chamber.

19. A method according to claim 15, wherein the pressure control method comprises:

operating an inlet valve so as to admit gas into the secondary recondensing chamber, thereby increasing the pressure of the gas within the secondary recondensing chamber; and operating a vent valve so as to release gas from the secondary recondensing chamber, thereby reducing the pressure of the gas within the secondary recondensing chamber.

20. A method according to claim 19, wherein the steps of operating are controlled by a controller arranged to control operation of the inlet valve and the vent valve.

21. A method according to claim 19, further comprising the step of determining a pressure of a gas within the cryogen vessel and controlling operation of the inlet valve and the vent valve according to the determined gas pressure.

22. A method according to claim 19, further comprising the step of determining an operational status of an equipment located within the cryogen vessel and controlling operation of the inlet valve and the vent valve according to the determined operational status.

* * * * *